United States Patent [19]

Pedersen

[11] 4,399,950

[45] Aug. 23, 1983

[54] MAGAZINE FOR WINDING WIRE ON ENDLESS ANNULAR MEMBERS OR CORES

[75] Inventor: Jan B. Pedersen, Hvalsϕ, Denmark

[73] Assignee: Tortrix A/S, Vejle, Denmark

[21] Appl. No.: 269,017

[22] PCT Filed: Sep. 18, 1980

[86] PCT No.: PCT/DK80/00057

§ 371 Date: May 13, 1981

§ 102(e) Date: May 13, 1981

[87] PCT Pub. No.: WO81/00840

PCT Pub. Date: Apr. 2, 1981

[51] Int. Cl.³ ..... H01F 41/08

[52] U.S. Cl. ..... 242/4 B; 57/10; 242/7.21

[58] Field of Search ..... 242/4 B, 4 BE, 4 R, 242/7.21, 7.22; 57/10, 18, 13; 156/425, 428

[56] References Cited

U.S. PATENT DOCUMENTS 3,669,365 6/1972 Loturco ..... 242/4 B

FOREIGN PATENT DOCUMENTS

WO79/00763 10/1979 PCT Int'l Appl. .

770545 3/1957 United Kingdom ..... 242/4 B 789434 1/1958 United Kingdom ..... 242/4 B

*Primary Examiner*—Billy S. Taylor

*Attorney, Agent, or Firm*—Schwartz, Jeffery, Schwaab, Mack, Blumenthal & Koch

[57] ABSTRACT

A wire magazine for winding wire for use in a winding machine for the winding of elongate members or cores, preferably endless cores, comprises two annular halves (9, 10) which are designed with thin walls of a substantially semicircular cross-sectional form to provide substantially closed storage space. The halves are separated by a wire filling slit (11) on the external side of the magazine and a bottom slit (12) on the underside of the magazine facing it axis of revolution, said bottom slit (12) being defined by edge portions of the two halves (9, 10) having walls, the surfaces of which deviate from a planar parallel relationship to the symmetry plane of the wire magazine normal to the axis of revolution. With this design of the wire magazine, an optimum residual hole condition in the winding of toroidal cores is obtained and simultaneously an efficient holding of winding wire within the magazine after cutting of the wire is secured in addition to an improved security against slipping of the wire drawn out through the bottom slit (12) and an optimum possibility for correct control of the friction between the wire and the walls of the bottom slit (12) and, thereby, of the wire tension. The walls of the bottom slit may, for example, have a longitudinal wave form.

9 Claims, 14 Drawing Figures

MAGAZINE FOR WINDING WIRE ON ENDLESS ANNULAR MEMBERS OR CORES

TECHNICAL FIELD

The present invention relates to a wire magazine for winding wire for the winding of elongate members or cores, preferably endless cores, for use in a winding machine comprising a machine frame with a magazine holder including guide means and driving means for rotational movement of the wire magazine, said wire magazine comprising two annular halves, each of which is composed of two semi-annular parts separated by joining faces and limiting together a wire storage space, the cross-sectional area of which is considerably greater than the wire diameter, said two halves being separated by a bottom slit facing an axis of revolution for the wire magazine, through which winding wire is drawn out from the wire magazine.

BACKGROUND ART

Wire magazines of this kind are used in winding machines of the so-called single-ring type or the so-called double-ring type operating with immediate or direct winding, since the drawing of the winding wire through a bottom slit opens the opportunity for filling winding wire into the magazine from the external side thereof in one and the same operation, i.e. with the same direction of rotation for the magazine, as the winding operation.

In a prior art winding machine known from U.S. Pat. No. 2,974,890, the wire magazine is formed by two concentric rings, each of which has a circular cross section, said rings being positioned in contact with each other with a common axis of revolution. This prior art machine has not found any application in practice, mainly due to the following disadvantages.

In order to allow a selective wire drawing, the wire diameter must be great relative to the cross-sectional dimensions of the two magazine rings.

In order to avoid an acute drawing angle whereby the wire tension will be mainly directed in a tangential direction with a risk of slipping of the wire in the bottom slit, the winding object must be centrally positioned relative to the wire magazine, as a result of which narrow limits are set for the size of toroidal members which can be wound, on one hand, said requirement resulting together with the demands to the wire diameter in inferior residual hole conditions in the winding of toroidal cores, on the other hand.

Since the magazine is opened on the external side and only limited by the upper sides of the two magazine rings, it is not possible to control the wire supply after cutting of the wire. As a result thereof, it is prescribed that the filling of wire into the magazine must be continued until the winding operation has been completed, at which time a considerable unused wire supply will be collected in the magazine and must either be return-coiled or discarded.

From applicants' international patent application No. PCT/DK79/00008, international publication No. WO 79/00763, winding machines are known, in which a wire magazine of the kind mentioned is closed on the external side either by a driving belt for rotating the wire magazine or, for a machine of the double-ring type, by a separate braking belt for the wire magazine. Through the improved control of the wire supply after cutting obtained thereby, the cutting may be performed prior to completion of the winding operation, and the winding may be finished with the wire supply remaining in the magazine after cutting.

However, the closing of the magazine requires a special design of driving or braking means for the wire magazine and, thus, is not suitable in machines in which the wire magazine is driven by rollers, such as in the case of the prior art machine described in the above mentioned U.S. patent specification. Furthermore, in the design of the magazine it must be taken into account that the walls of the magazine should provide a safe engaging abutment for the driving or braking belt, whereby it will not simultaneously be possible to fulfil the desire of an optimum residual hole condition for endless cores. In this connection, an optimum residual hole condition would mean that the residual hole remaining after winding of the core exceeds the cross-sectional area of the wire supply of the magazine with as small an amount as possible.

Moreover, in the prior art wire magazines, additional ring members of a flexible material are often required to define the bottom slit in order to achieve a sufficiently good control of the wire tension and avoid wire drawing after a chord course, whereby the construction becomes more complicated and expensive.

DISCLOSURE OF THE INVENTION

According to the invention, considerably improved characteristics of a wire magazine of the kind mentioned is obtained in that the two magazine halves are formed with thin walls having a substantially semi-circular cross-sectional form to provide a substantially closed storage space, said two halves being separated, in addition to said bottom slit, by an opposite wire filling slit only, said bottom slit being defined by edge portions of said two halves having walls, the surfaces of which deviate from a planar parallel relationship to the symmetry plane of the wire magazine normal to the axis of revolution. By designing the magazine halves in the manner indicated as thin-walled shells of semi-circular cross-sectional form, the best possible residual hole condition is obtained, since only the small thickness of the magazine walls will be added to the cross-sectional area of the wire supply.

Moreover, the substantially closed form secures efficient holding of the wire supply in the magazine after cutting of the wire without any demands being made to a special design of driving or braking means or to use of particular members for closing the magazine. In addition, the closed design results in considerable advantages with respect to safety of labour.

Furthermore, by the indicated design of the bottom slit, a considerably improved security against slipping of the wire during drawing is obtained even with the winding object positioned excentrically relative to the magazine and an optimum possibility for correct control of the friction between the wire and the walls of the bottom slit and, thereby, of the wire tension.

In particular, an efficient control will be obtained by using a wire magazine according to the invention in connection with a winding machine having an exchangeable magazine cassette as described in applicants' international patent application No. PCT/DK80/00058, International Publication No. 81/00841.

In a preferred embodiment, which is characterized in that said edge portions of said magazine halves form flanges extending towards the axis of revolution for extending the radial dimension of said bottom slit. The said extended radial dimension of the bottom slit will increase the friction surface between the wire and the slit walls, whereby a further improved possibility for accurate control of the drawing point will be obtained so as to provide a security against forward movement of the drawing point in the bottom slit without any accompanying wire drawing.

The non-planar form of the bottom slit maybe realized in that the walls of the bottom slit have longitudinally wave-formed surfaces.

In this connection, the slit walls may have such an angular position that the walls of the bottom slit are intersected by any axial plane through the axis of revolution in substantially straight lines which are mainly parallel to said symmetry plane normal to the axis of revolution.

Thereby, also the mouth of the bottom slit facing the axis of revolution will get a longitudinally wave or sine-formed course which, however, will not play any role in most winding operations.

However, if it is desired in connection with precision winding of cores for use in the controllable resistors or transformers that the bottom slit lies substantially in the symmetry plane normal to the axis of revolution, this can be realized in that the inlet to said bottom slit facing the supply space of the magazine is longitudinally wave-formed, whereas the edges of said flanges facing the axis of revolution extend in parallel planes normal to the axis of revolution. Thereby, the angular position of said flanges relative to the magazine halves will show a sine-formed variation along the circumference of the magazine.

However, if it is desired to avoid this complication, the mouth of the bottom slit may be caused to lie in one and the same plane normal to the axis of revolution by an alternative design which is characterized in that said edge portions overlap each other to define a bottom slit, the walls of which have surfaces following substantially parallel cone surfaces with a relatively small apex angle.

In order to facilitate the filling of wire into the magazine through the relatively narrow filling slit without any risk for damaging the wire, it is advantageous that said filling slit has walls, the surfaces of which follow cone faces which are symmetric around said symmetry plane in the magazine normal to the axis of revolution. In practice, this can be realized in a simple manner in that the walls of the filling slit are formed by edge portions of said two magazine halves, which are bent inwardly towards the supply space of the magazine.

Corresponding to a wave-formed design of the bottom slit, improved closing of the filling slit may in this design be obtained in that the edges of said edge portions facing said supply space are formed with tongues. In order to obtain an unencumbered introduction through this nearly closed slit, the magazine halves are positioned relative to each other so that the wave-forms of the tongue-formed edges are in-phase.

BRIEF DESCRIPTION OF THE DRAWINGS

In the following, the invention will be explained in further detail with reference to the drawings, in which.

DETAILED DESCRIPTION

Figure 1:
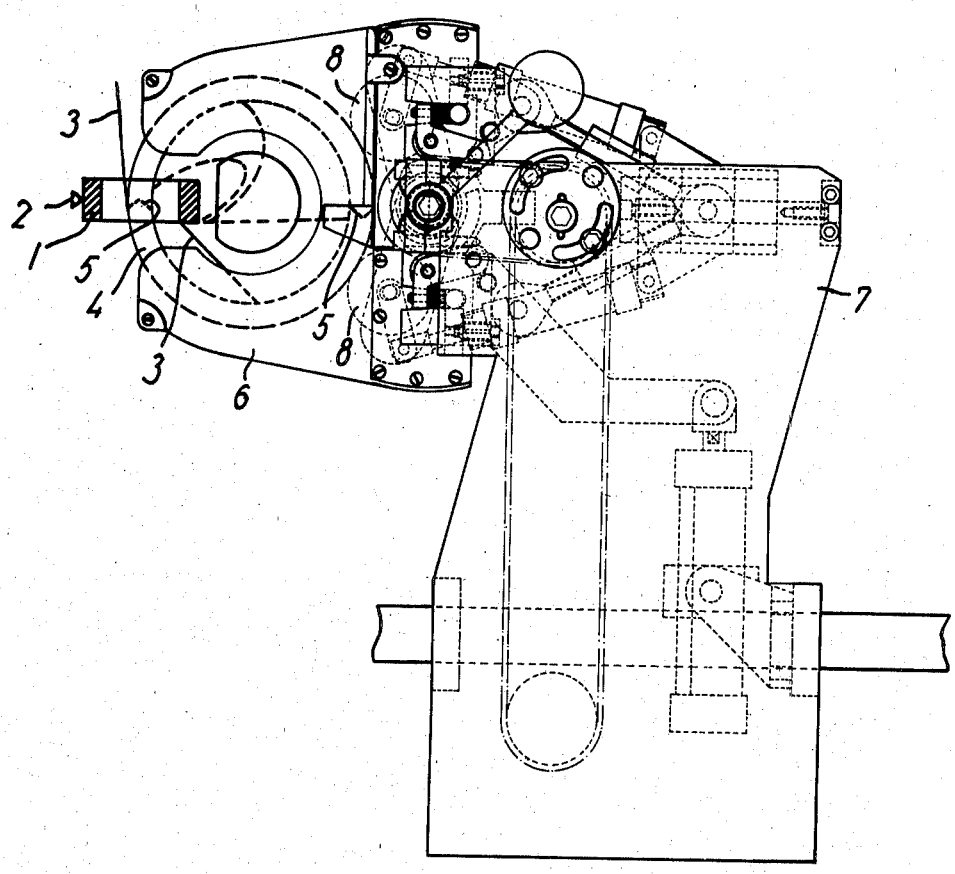
FIG. 1 shows a winding machine with a wire magazine according to the invention.

The winding machine shown in FIG. 1 is of the kind described in the specification of applicants' international patent application No. PCT/DK80/00058, International Publication No. 81/00841 and will, therefore, only be briefly explained, reference being made to said international patent application for a more detailed explanation.

In the winding machine, a toroidal core 1 guided in guide means 2, which are only schematically shown, is wound with winding wire 3 by means of a rotating wire magazine 4 which is only schematically shown in FIG. 1 and comprises two annular halves, each of which is composed of two parts separated by joining faces 5, so that the magazine may be opened along a diameter for positioning and removal of the core 1. The two annular halves of the magazine form together a storage space for the winding wire 3 and are separated on the external side of the magazine by a filling slit, not shown in FIG. 1, whereas wire to be wound onto the core 1 is drawn out from the magazine through a bottom slit, likewise not shown in FIG. 1, facing the axis of revolution for the magazine. By this design, it is made possible that winding wire may be filled into the wire magazine, and the core may be wound in one and the same operation with the same direction and speed of rotation for the magazine 4.

In the winding machine as illustrated, the wire magazine 4 is journalled by guide means, not shown, in a cassette 6 which may be coupled exchangeably to the frame 7 of the winding machine, in which driving means for rotation of the wire magazine 4 comprises, inter alia, a pair of intermediate rollers 8 engaging the wire magazine. In addition, the machine frame 7 comprises operator means for opening and closing of the two parts of the cassette 6 which are pivotally journalled with each other, such as explained in the above-mentioned international patent application, whereby also the wire magazine 4 may be opened and closed. Moreover, the guide means in the cassette 6 for the wire magazine 4 comprise means for adjusting the contact pressure against the annular magazine halves and, thereby, controlling the tension of the wire 3 drawn out from the magazine 4.

In the preferred embodiment of a wire magazine according to the invention shown in FIGS. 2 to 8, the magazine comprises two annular halves 9 and 10, each of which is composed of two semi-annular parts *9a*, *9b* and 10*a*, 10*b*, respectively, separated by the joining faces 5. As seen in the perspective view in FIG. 2, the halves 9 and 10 are separated on the side facing away from the axis of revolution of the wire magazine by the wire filling slit 11, whereas on the opposite side facing the axis of revolution, they are separated by a bottom slit 12 for drawing out the winding wire.

Figure 2:
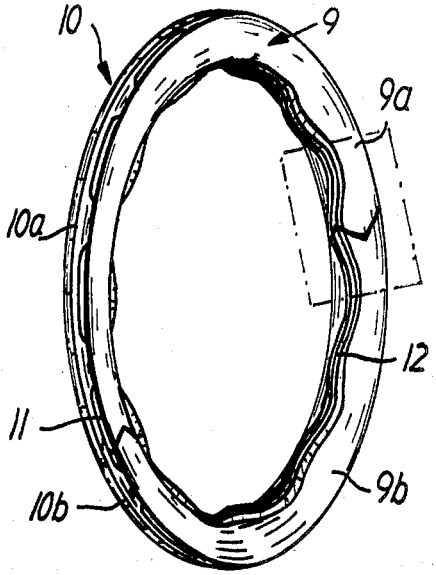
FIG. 2 is a perspective view of an embodiment of the wire magazine.

For a more detailed illustration of the invention, reference is made in the following to FIGS. 3 to 8 which show a number of representations of the part of the wire magazine situated within a dashed-line frame in FIG. 2. As shown in the sectional views in FIGS. 6 to 8, the halves 9 and 10 are designed in accordance with the invention with thin walls of a substantially semi-circular cross-sectional form to provide a substantially closed storage space 13, the walls of which formed by the halves 9 and 10 are only broken by the bottom slit 12 for drawing out the winding wire and the opposed wire filling slit 11.

Figure 3:
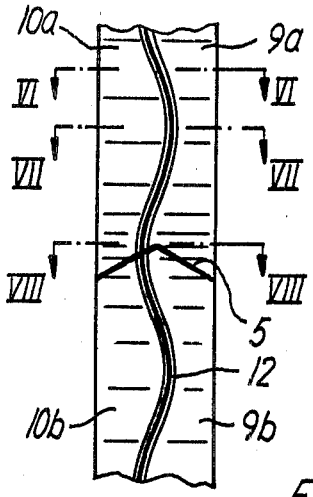
FIG. 3 is an unfolded view of a part of the side of the wire magazine in FIG. 2 facing the axis of revolution.
Figure 5:
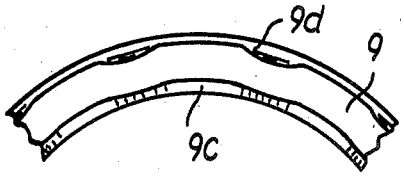
FIG. 5 shows a portion of one half of the wire magazine viewed from the interior of the magazine.

As most clearly apparent from the unfolded view in FIG. 3 of the side of the magazine facing the axis of revolution, the bottom slit 12 is defined according to the invention by edge portions of the magazine halves 9 and 10 having walls, the surfaces of which deviate from a planar parallel relationship with the symmetry plane of the wire magazine normal to the axis of revolution. In the embodiment shown, said edge portions form flanges 9*c* and 10*c*, respectively, projecting against the axis of revolution, as shown in FIGS. 6 to 8, said flanges extending the radial dimension of the bottom slit 12 to provide a greater friction surface for the winding wire passing through the slit.

Moreover, as shown in FIG. 3, the non-planar course of the walls of the bottom slit 12 is obtained in the embodiment shown in that the surfaces of said walls, in this case formed by the flanges 9*c* and 10*c*, have a longitudinal wave-form. This wave-form may substantially be a sine-wave, in which the amplitude and frequency are matched to the range of wire dimensions, for which the magazine is to be used, the rotational speed of the magazine, etc.

Figure 6:
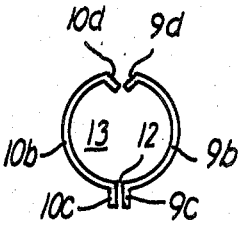
FIGS. 6 to 8 are sectional views after the lines VI—VI, VII—VII and VIII—VIII in FIGS. 3 and 4, respectively.
Figure 7:
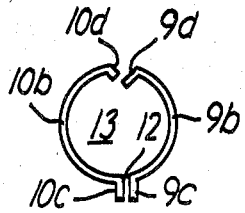
Figure 8:
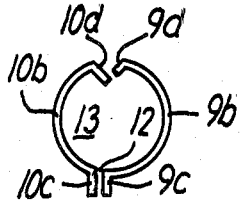
Figure 9:
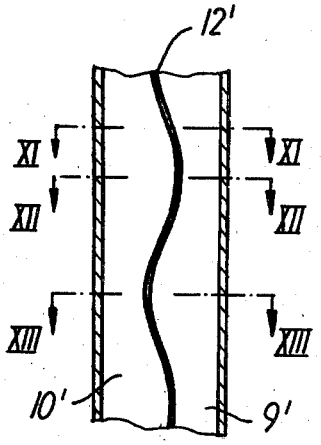
FIG. 9 is an unfolded view of a part of another embodiment of the wire magazine according to the invention viewed from the interior of the magazine towards the axis of revolution.

In the embodiment shown, the flanges 9*c* and 10*c* have independent of the wave-form such an angular position relative to the magazine halves 9 and 10 that the walls of the bottom slit 12 are intersected by any axial plane through the axis of revolution of the magazine in substantially straight lines which are substantially parallel to the symmetry plane normal to the axis of revolution, such as shown in FIGS. 6 to 8.

Figure 4:
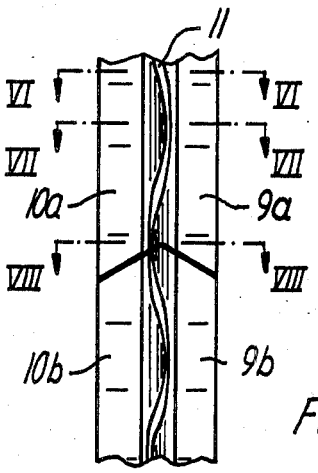
FIG. 4 is an unfolded view of a part of the opposite side of the wire magazine in FIG. 2.

In order to facilitate the introduction of winding wire into the magazine, the filling slit 11 is formed as shown in FIGS. 6 to 8 with walls following cone faces which are symmetrical relative to the symmetry plane of the magazine normal to the axis of revolution, said walls of the filling slit being formed by edge portions 9*d* and 10*d*, respectively, of the two magazine halves 9 and 10 bent inwardly towards the storage space 13. As shown in FIGS. 5 to 8, an improved closing of the magazine may be obtained also at the filling slit in that the edges of said edge portions 9*d* and 10*d* facing the storage space 13 are designed with tongues. Thereby, the filling slit 11 will show a wave-formed course when viewed from the outside, such as shown in FIG. 4, in which the wave forms of the two tongue-shaped edges are in-phase in order to obtain an unrestricted wire introduction and simultaneously the maximum possible closing effect for the wire end after cutting of the winding wire.

In the embodiment shown in FIGS. 2 to 8, the general wave-form of the bottom slit 12 will have as a result that also the mouth of the slit 12 facing the axis of revolution becomes wave-formed. For most practical winding operations, the lateral oscillation of the winding wire in the wiring between the magazine and the toroidal core 1 caused thereby will not play any role.

Figure 10:
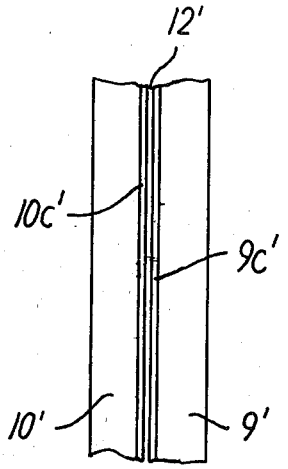
FIG. 10 is an unfolded view of a part of the same wire magazine on the external side facing the axis of revolution.

However, in some winding operations associated particularly with the production of controllable resistors and transformers, it is desired to have the winding made with a greater accuracy, and for this purpose the wire magazine according to the invention may be designed with the embodiment shown in FIGS. 9 to 13, so that the mouth of the bottom slit towards the axis of revolution will extend in one and the same plane, i.e. the symmetry plane of the magazine normal to the axis of revolution, such as illustrated in FIG. 10.

Figure 11:
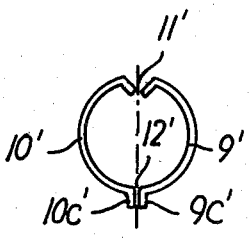
FIGS. 11 to 13 are sectional views after the lines XI—XI, XII—XII and XIII—XIII, respectively, in FIG. 9.
Figure 12:
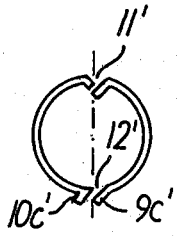
Figure 13:
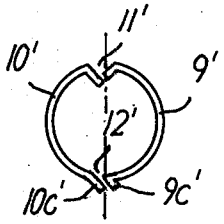

In this embodiment, the inlet to the bottom slit 12′ from the storage space 13′ of the magazine between the two magazine halves 9′ and 10′ has a wave-formed course in the same manner as for the entire bottom slit in the embodiment shown in FIGS. 2 to 8. The flange portions 9*c*′ and 10*c*′ of the magazine halves 9′ and 10′, respectively, defining the bottom slit 12′ in this embodiment are formed, however, with angular positions relative to the magazine halves 9′ and 10′ showing a substantially sine-wave variation along the circumference of the magazine, such as shown in FIGS. 11 to 13, whereby the mouth of the bottom slit 12′ will get the straight line course shown in FIG. 10.

In the embodiment shown in FIGS. 9 to 13, the filling slit 11′ may be designed in the same way as the filling slit 11 in the embodiment shown in FIGS. 2 to 8.

Figure 14:
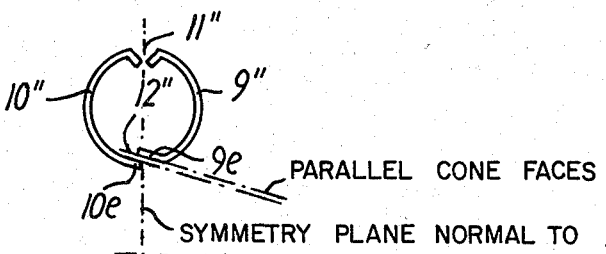
FIG. 14 is a sectional view of a third embodiment of a wire magazine according to the invention.

However, as shown in FIG. 14, a straight line course of the mouth of the bottom slit towards the axis of revolution of the magazine may also be obtained in that the edge portions 9*e* and 10*e* of the magazine halves 9″ and 10″, respectively, defining the bottom slit 12″ overlap each other, whereby the walls of the bottom slit 12″ are made to follow substantially parallel cone faces having a relatively small apex angle. Also in the embodiment shown in FIG. 14, the filling slit 11″ may be designed in the same way as explained with reference to FIGS. 2 to 8.

The invention is not limited to the embodiments of the wire magazine shown in the drawings, since particularly the filling slit and the bottom slit may have a different design without deviating from the scope of the invention.

Neither is the wire magazine limited to use in a winding machine as described having an exchangable cassette, but may also be applied in winding machines, in which a magazine holder having guide means is firmly connected with the machine frame.

I claim:

1. A wire magazine for winding wire for use in a winding machine for the winding of elongate members or cores, particularly endless cores, said machine comprising a machine frame with a magazine holder including guide means and driving means for rotational movement of the wire magazine, said wire magazine comprising two annular halves, each of which is composed of two semi-annular parts separated by joining faces and limiting together a wire supply space, the cross-sectional area of which is considerably greater than the wire diameter, said two halves being separated by a bottom slit facing an axis of revolution for the wire magazine, through which winding wire is drawn out from the wire magazine, said two magazine halves being formed with thin walls having a substantially semi-circular cross-sectional form to provide a substantially closed storage space, said two halves being separated opposite to said bottom slit by a single wire filling slit, said two halves being formed with edge portions having opposed walls limiting said bottom slit, the surfaces of said opposed walls deviating from a planar parallel relationship to the symmetry plane of the wire magazine normal to the axis of revolution.

2. A wire magazine as claimed in claim 1, wherein said edge portions of said magazine halves form flanges extending towards the axis of revolution for extending the radial dimension of said bottom slit.

3. A wire magazine as claimed in claim 1 or 2 wherein, said opposed walls limiting said bottom slit have longitudinally wave-formed surfaces.

4. A wire magazine as claimed in claim 3, wherein said opposed walls of the bottom slit are intersected by any axial plane through the axis of revolution in substantially straight lines which are mainly parallel to said symmetry plane normal to the axis of revolution.

5. A wire magazine as claimed in claim 2, wherein the inlet to said bottom slit facing the supply space of the magazine is longitudinally wave-formed, whereas the edges of said flanges facing the axis of revolution extend in parallel planes normal to the axis of revolution.

6. A wire magazine as claimed in claim 1, wherein said edge portions overlap each other to define a bottom slit, the opposed walls of which have surfaces following substantially parallel cone surfaces with a relatively small apex angle relative to the axis of revolution of the magazine.

7. A wire magazine as claimed in claim 1, 2, 5 or 6 wherein said filling slit has walls, the surfaces of which follow cone faces which are symmetric around said symmetry plane in the magazine normal to the axis of revolution.

8. A wire magazine as claimed in claim 2, wherein the walls of the filling slit are formed by edge portions of said two magazine halves, which are bent inwardly towards the supply space of the magazine.

9. A wire magazine as claimed in claim 8, wherein the edges of said edge portions facing said supply space are formed with tongues.

* * * * *